US005617713A

United States Patent [19]

Mawick et al.

[11] Patent Number: 5,617,713

[45] Date of Patent: Apr. 8, 1997

[54] YARN HAVING METALLIC FIBERS AND AN ELECTROMAGNETIC SHIELD FABRIC MADE THEREFROM

[75] Inventors: Peter Mawick, Nordendorf; Subrata Choudhury, Stadtallendorf, both of Germany

[73] Assignees: NSP Sicherheits-Produkte GmbH, Nordendorf; TG Techno-Garne GmbH, Stadtallendorf

[21] Appl. No.: 311,898

[22] Filed: Sep. 26, 1994

Related U.S. Application Data

[63] Continuation of Ser. No. 623,373, Oct. 18, 1991, abandoned.

[30] Foreign Application Priority Data

Jun. 13, 1988 [DE] Germany ..... 38 20 127.5
Jun. 13, 1988 [DE] Germany ..... 38 20 091.0

[51] Int. Cl.[6] ..... D01H 3/02; D01H 3/08
[52] U.S. Cl. ..... 57/210; 57/224; 57/901
[58] Field of Search ..... 57/210, 224

[56] References Cited

U.S. PATENT DOCUMENTS

| | | | |
|---|---|---|---|
| 3,490,224 | 1/1970 | Bourgeas | 57/901 X |
| 3,828,543 | 8/1974 | Goodbar et al. | 57/901 X |
| 3,851,456 | 12/1974 | Hamada et al. | 57/901 X |
| 3,882,667 | 5/1975 | Barry | 57/901 X |
| 3,987,613 | 10/1976 | Woods et al. | 57/104 |
| 4,384,449 | 3/1983 | Byrnes et al. | 57/210 |
| 4,647,495 | 3/1987 | Kanayama et al. | 57/901 X |
| 4,793,130 | 12/1988 | Togashi et al. | 57/210 |
| 4,926,910 | 5/1990 | Wade | 139/425 R |
| 5,103,504 | 4/1992 | Dordevic | 2/243 |
| 5,248,548 | 9/1993 | Toon | 57/210 |
| 5,287,690 | 2/1994 | Toon | 57/210 |
| 5,442,815 | 8/1995 | Cordova et al. | 2/161.7 |

FOREIGN PATENT DOCUMENTS

| | | | |
|---|---|---|---|
| 0250260 | 6/1987 | European Pat. Off. . | |
| 2599762 | 12/1987 | France . | |
| 2668176 | 4/1992 | France | 57/210 |
| 1047837 | 3/1986 | Japan | 57/210 |
| 1033228 | 2/1989 | Japan | 57/224 |
| 3227422 | 10/1991 | Japan | 57/210 |
| 2018323 | 10/1979 | United Kingdom . | |

OTHER PUBLICATIONS

Man–Made Textiles, Jan. 1966, p. 33, "Stainless Steel–Fibers of the Future".

Webster's Unabridged Dictionary, Second Edition, pp. 680 and 684.

*Primary Examiner*—William Stryjewski
*Attorney, Agent, or Firm*—Sughrue, Mion, Zinn, Macpeak & Seas

[57] ABSTRACT

A yarn for making an electromagnetic shield fabric includes at least one textile thread containing metallic fibers and other fibers which particularly but not exclusively may be man-made fibers. The predominant portion of the metallic fibers or the entire content of metallic fibers is arranged in the inner cross-sectional area of the textile thread. The outer cross-sectional area of the textile thread sheathing the inner cross-sectional area is made predominantly or exclusively of fibers well tolerated by the skin, particularly natural fibers and/or man-made fibers. The yarn which may consist of said textile thread itself or which may be a twisted yarn produced using one or several of such textile threads may be processed into fabrics, warp-knitted fabrics or knittings serving to shield electromagnetic radiation and which are physiologically well tolerated and have good further processing properties as well as are easy to clean. Furthermore, this invention provides the use of this yarn as a woven, warp-knitted or knitted material of garments protecting against electromagnetic radiations and/or interferences.

7 Claims, 1 Drawing Sheet

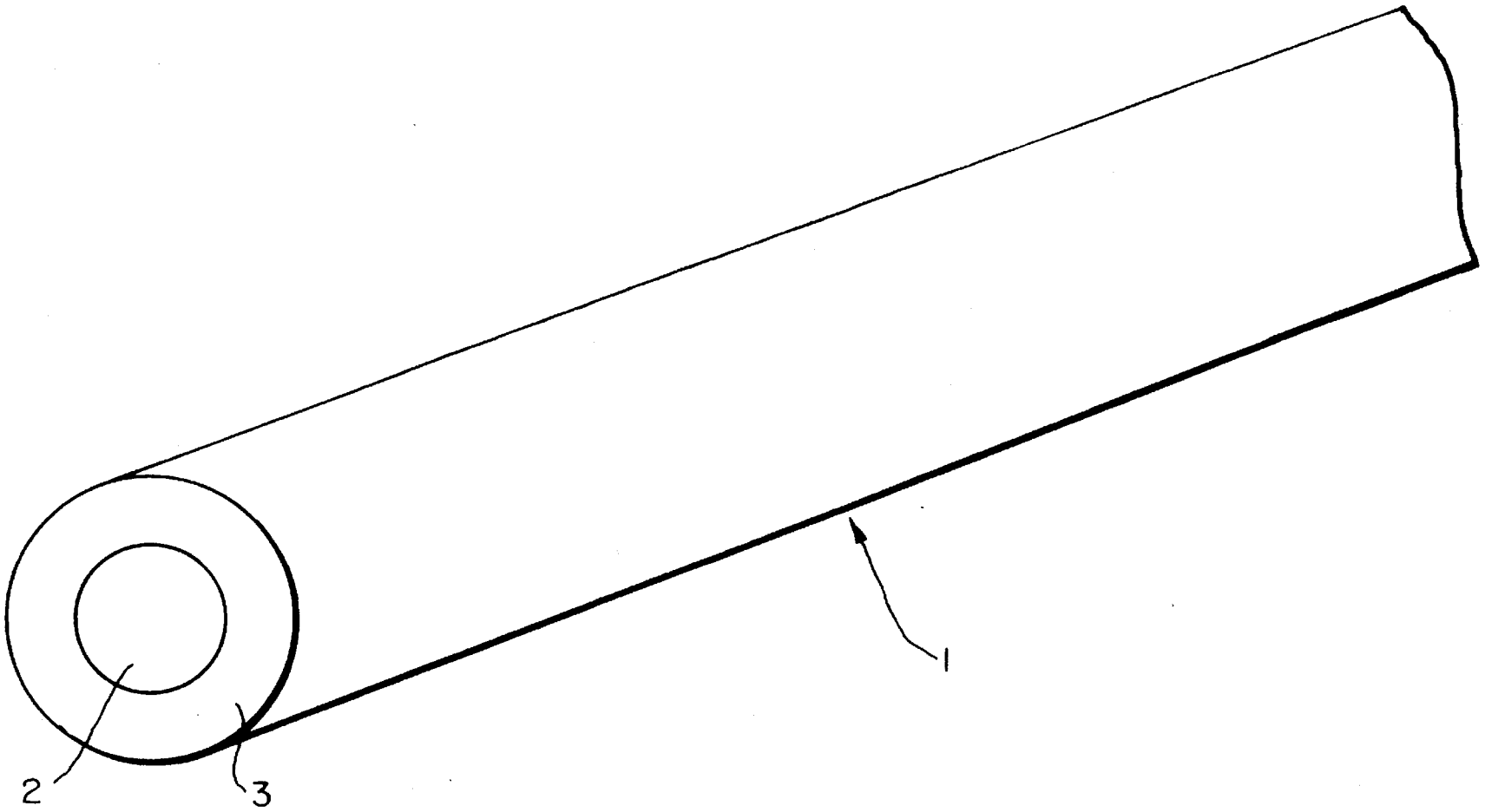
1
2
3

YARN HAVING METALLIC FIBERS AND AN ELECTROMAGNETIC SHIELD FABRIC MADE THEREFROM

This is a Continuation of application Ser. No. 07/623,373 filed Oct. 18, 1993, now abandoned.

BACKGROUND OF THE INVENTION

The present invention relates to a yarn consisting of at least one textile thread containing metallic fibers and other fibers, for example man-made fibers, the majority of the metallic fibers or the total content of metallic fibers being arranged within the inner cross-sectional area (2) of the textile thread (1), while the outer cross-sectional area (3) of the textile thread (1) sheathing the inner cross-sectional area (2) consists predominantly or exclusively of fibers well tolerated by the skin, particularly natural fibers and/or man-made fibers. Furthermore, the invention relates to the production and use of said yarn.

A yarn was proposed for the production of a fabric used for shielding electromagnetic radiation, which consists of steel fibers, polyester fibers and polyamide fibers spun into a textile thread which either forms the yarn itself or several of which textile threads are twisted into a yarn. On the average the steel fibers, polyester fibers and polyamide fibers of this textile thread are distributed uniformly over the cross-section of the textile thread.

A fabric consisting of such textile threads has a number of disadvantages:

(a) Since a very considerable portion of the steel fibers is externally exposed and thus contacts the skin of a person wearing for example a shirt made of such a fabric without a garment underneath, such a fabric is tolerated only poorly by the skin because the steel fibers do not only scratch the skin but also effect for example itching, allergies, etc.

(b) Although the above-mentioned drawback resulting from the fact that the fabric contacts the skin of the user can be eliminated by underlining the garment made of this fabric, this results in poor wearing qualities apart from the costs and material needed for the underlining since the garment becomes too warm due to this underlining.

(c) Externally, i.e. on the side facing away from the wearer's skin, the exposed steel fibers are also disadvantageous, particularly insofar as it is unpleasant to externally touch a garment made of this fabric and the steel fibers are disadvantageous for garments worn thereover since they effect heavy wear and tear on such garments, etc.

(d) Another drawback consists in that the steel fibers impart a slightly gray appearance to the fabric, which can be changed by dyeing the fabric where this slightly gray appearance is not desired. However, such a dyeing does not always lead to beautiful colors, and the color the fabric obtains through dyeing cannot be determined in advance with sufficient accuracy since the steel fibers do not take the dye and as a result cause a gray tinge. Due to the gray tinge of the steel fibers light colors therefore become "dirty".

(e) Although the last two drawbacks referring to the external effect of the fabric can be overcome by covering the fabric with a fabric free of steel fibers or the like, this deteriorates the wearing qualities even more since the user of such a garment feels even warmer than already is the case with the above-mentioned underlining in any case, the material required and the costs increasing even more as a result of lining.

EP-A-250 260, GB-A-2 018 323 and FR-A-2 599 762 disclose yarns containing metal only within the inner cross-sectional area, while the outer cross-sectional area is made of textile material. However, the metal is provided as a metal wire or several parallel metal wires within the yarn. Such metal wires have a number of drawbacks. One of these drawbacks consists in that the yarn becomes relatively stiff, and it becomes the stiffer, the thicker the metal wire and the less soft the metal used. Due to this stiffness, a fabric, warp-knitted fabric or knitting made of the yarn becomes difficult of processing, physiologically not well tolerable, uncomfortable when worn and poorly cleanable. Another disadvantage consists in that the displacement strength of the yarn, i.e. the cohesion between inner core and outer sheathe, is relatively poor. Still another disadvantage consists in that possibly relatively much metal wire, particularly steel wire, has to be used for shielding against electromagnetic radiation as a function of radiation frequency. As a result, the already relatively stiff fabric, warp-knitted fabric or knitting made of this yarn becomes even stiffer and thus physiologically even less tolerable and more uncomfortable.

Apart from the above-mentioned drawbacks, the covering yarns according to EP-A-250 260 and GB-A-2 018 323 have the disadvantage that they have to be produced in a two-step or multi-step process in order to avoid unfavorable yarn twisting resulting with only one covering layer around the inner core containing the metal wire.

In addition to the above-mentioned drawbacks, the yarn according to FR-A-2 599 762, has the further disadvantage that the displacement strength is especially poor because the metal wire provided within the core has very poor displacement strength with respect to the outer sheathe. As a result, the yarn is, among others, poorly processable.

SUMMARY OF THE INVENTION

The object of this invention is in particular to provide a yarn having the advantages of the above-mentioned yarn made of steel fibers, polyester fibers and polyamide fiber, i.e. rendering possible shielding of electromagnetic fields, without having the drawbacks of the above-mentioned yarn.

The object of this invention is in particular to provide a yarn of the kind according to the preamble, which can be processed into a fabric, warp-knitted fabric or knitting, which is physiologically tolerated, has good wearing properties, can easily be processed and cleaned and shields against electromagnetic radiation within a broad frequency and intensity range.

According to the present invention, this problem is solved with a yarn of the kind mentioned at the beginning in that the metal is contained within the textile thread in the form of metal fibers, some of the metal fibers anchored within the inner cross-sectional area extending into the outer cross-sectional area.

As a result a textile thread is obtained which has an inner cross-sectional area and an outer cross-sectional area sheathing the former one, (a) the inner cross-sectional area of which having the property of shielding electromagnetic radiation due to its content of metallic fibers and (b) the outer cross-sectional area having the property that it makes a fabric, warp-knitted fabric or knitting made of this yarn well tolerable for the skin and externally imparts the advantageous properties of common textiles to this fabric, warp-knitted fabric or knitting. In particular it can be dyed well, neatly and determinable in advance and can be cleaned well, for example in a washing machine, owing to the fact that the sheating outer cross-sectional area forms an external cover of the metallic fibers which is well tolerated by the skin and prevents the metallic fibers from having external disadvantageous effects.

Furthermore, this invention is to provide a use of the yarn according to the invention which has the advantages of this yarn as mentioned above.

This use consists in that the yarn is used as woven, warp-knitted or knitted material of garments protecting against electromagnetic radiations and/or interferences.

In this case a textile thread is used as a yarn or twisted in the yarn which has an inner cross-sectional area and an outer cross-sectional area sheathing the former which areas have the properties mentioned above under items (a) and (b).

Reference is to be made to the fact that there exist yarns having an inner cross-sectional area differing from the sheathing outer cross-sectional area. However, the inner cross-sectional area of these yarns referred to as corespun consists of a continuous filament and/or thread spirally sheathed by fiber strands of the outer cross-sectional area. The filament and/or the thread is to impart to the yarn a high longitudinal tensile strength and when using this core-spun yarn as a sewing yarn the outer cross-sectional area serves to shield the heat-sensitive thread from the heat generated in the yarn when sewing with a machine. Thus, this invention differs fundamentally from a corespun yarn with respect to both the underlying problem and the solution since the inner cross-sectional area of the yarn according to this invention does not serve to produce a high longitudinal tensile strength nor does the outer cross-sectional area serve to shield the inner cross-sectional area from disadvantageous or destructive exterior effects.

The textile thread obtained by the invention can be used either directly-as a yarn for the production of fabrics, warp-knitted fabrics or knittings, or together with textile threads of the same kind and/or other textile threads containing no metallic fibers it can be twisted into a yarn which is then processed into fabrics, warp-knitted fabrics or knittings.

Irrespective of whether the textile thread having a structure according to this invention is used as such or twisted with textile threads of the same kind and/or other textile threads, this invention already provides a yarn which has the above advantages aspired according to the object, particularly renders possible the shielding against electromagnetic fields, and furthermore has the advantage that a fabric, warp-knitted fabric or knitting made thereof is well tolerated by the skin on both its side facing a wearer's skin and its side facing away from the wearer's skin, can be dyed easily, in a way determinable in advance and in a clean manner and is altogether of high wearing quality for the user as well as saves the fabrics, warp-knitted fabrics or knittings thereabove which are produced as usually and is drip-dry and easily washable.

The above statement that the outer cross-sectional area of the textile thread sheathing the inner cross-sectional area may consist "predominantly" of fibers well tolerated by the skin, particularly natural fibers and/or man-made fibers, refers particularly to the case in which some of the metallic fibers "anchored" in the inner cross-sectional area "protrude" into the outer cross-sectional area. In general, no metallic fibers are used according to this invention when producing the outer cross-sectional area sheathing the inner cross-sectional area although according to this invention the use of a minor amount of metallic fibers is not to be excluded when producing the outer cross-sectional area.

The yarn according to this invention may be developed in one of its embodiments in such a way that the inner cross-sectional area of the textile thread consists exclusively of metallic fibers. Another embodiment of the yarn according to this invention distinguishes itself in that the inner cross-sectional area of the textile thread consists of both metallic fibers and other fibers, i.e. non-metallic fibers, particularly man-made fibers and/or natural fibers.

By incorporating non-metallic fibers between the metallic fibers of the inner cross-sectional area of the textile thread it is rendered possible (a) to optimize the relation between shielding capacity of the yarn and weight proportion of metallic fibers and (b) to impart to the inner cross-sectional area of the textile thread certain desired textile properties obtainable by non-metallic fibers such as sweat-soaking or absorbing properties.

Accordingly, the yarn according to this invention may be developed in such a way that the inner cross-sectional area of the textile thread consists of metallic fibers and fibers soaking up or absorbing sweat, particularly man-made fibers soaking up or absorbing sweat.

As regards the kind of spinning structure the yarn according to this invention may have one of the two following structures, the structure mentioned in the beginning being particularly advantageous for reasons of production dealt with further below:

(1) The structure of the yarn according to this invention may be such that the inner cross-sectional area of the textile thread consists of a fiber bundle or strand not processed into yarn or twisted yarn as such, which is made of metallic fibers alone or of metallic fibers to which other fibers, particularly man-made fibers and/or natural fibers, are added and that the fibers well tolerated by the skin, particularly natural fibers and/or man-made fibers well tolerated by the skin, which sheath the fiber bundle or fiber strand are processed into a yarn along with the fiber bundle or strand.

(2) The structure of the yarn according to this invention may also be such that the inner c° ross-sectional area of the textile thread consists of a yarn or twisted yarn made of metallic fibers alone or of metallic fibers to which other fibers, particularly man-made fibers and/or natural fibers, are added. This inner cross-sectional area is sheathed by fibers well tolerated by the skin, particularly natural and/or man-made fibers well tolerated by the skin, which are spun with the yarn forming the inner cross-sectional area into the textile thread.

If the yarn according to this invention has the former of these two structures, it can be produced in an extraordinarily advantageous way in a single process step comprising sheathing of the fiber bundle not processed into yarn or twisted yarn or the fiber strand not processed into yarn or twisted yarn, which bundle or strand consists of metallic fibers alone or of metallic fibers to which other fibers, particularly man-made fibers and/or natural fibers, are added, with the fibers well tolerated by the skin, particularly natural fibers and/or man-made fibers well tolerated by the skin and processing into the desired yarn.

With respect to the scope of production and thus the production costs this special process according to the invention renders possible a very inexpensive manufacture of yarn according to this invention, a particularly firm bond being simultaneously obtained between the inner cross-sectional area and the outer cross-sectional area sheathing the former one.

However, the yarn according to this invention may also be produced in two basic process steps, i.e. in a first process step by forming a yarn or twisted yarn made of metallic fibers alone or of metallic fibers to which other fibers, particularly man-made fibers and/or natural fibers, are added and in a second process step by sheathing the yarn produced in such a way or the twisted yarn produced in such a way with fibers well tolerated by the skin, particularly natural fibers and/or man-made fibers well tolerated by the skin, and spinning it.

This process is particularly advantageous when the fibers forming the outer cross-sectional area which are spun around the yarn forming the inner cross-sectional area or the twisted yarn forming the inner cross-sectional area are dispersed laterally, particularly substantially in parallel with the yarn or twisted yarn axis during spinning and the entire product is twisted, i.e. in contrast to the production of a corespun yarn the fiber bundle or yarn or twisted yarn is not enwound as done in the corespun process during enwinding the filament and/or single thread.

Although in the yarn according to this invention and its production by the process according to this invention and its use the metallic fibers preferably used are steel fibers made of stainless steel, the metallic fibers used may also be made of other metals, for example they may be made of aluminum, aluminum alloys, copper, copper alloys or the like.

All textile fibers well tolerated by the skin may be used as fibers well tolerated by the skin. The fibers well tolerated by the skin which are particularly preferred are in particular cotton fibers because they are specifically well tolerated by the skin and can be cleaned very well, for example in washing machines, and/or wool fibers. The fibers well tolerated by the skin may also be a mixture of natural fibers and man-made fibers, for example a mixture of cotton fibers and polyester fibers.

For reasons of industrial safety or for military reasons it may be preferable to use flame-retardant and/or thermostable fibers such as aramid fibers as fibers well tolerated by the skin.

BRIEF DESCRIPTION OF THE DRAWING

The single FIGURE of the drawing is a perspective cross-sectional view of a yarn according to the invention.

DETAILED SUMMARY OF THE INVENTION

The single FIGURE of the drawing shows a diagram of a textile thread 1 according to this invention, whose inner cross-sectional area 2 consists of metallic fibers or contains metallic fibers, while the outer cross-sectional area 3 was made by sheathing the inner cross-sectional area 2 by means of fibers well tolerated by the skin, preferably exclusively by fibers well tolerated by the skin.

The metallic fibers preferably used are steel fibers made of stainless steel. By definition, steel fibers are spinnable fibers and used as components for synthetic fibrous materials to discharge static electricity and are made of stainless steel. They are supplied in finenesses of 8 to 40 μm in diameter but also have angular cross-sectional shapes. Steel fibers are supplied as steel slivers of 0.5 to 7 g/m and with staple lengths of 50 to 250 mm. Thus the steel fibers in the inner cross-sectional area of the yarn are discreet, non-continuous fibers as opposed to the filaments or wires of the prior art discussed above.

Fabrics, warp-knitted fabrics or knittings madder the yarn according to this invention can be used for protective garments where electromagnetic radiation exists having such an intensity and such a very wide frequency range that health problems result rendering necessary or advantageous to wear such protective garments.

Thus, cardiac pacemakers may be inhibited by electromagnetic fields and microwave rays, i.e. their frequency may be affected or even stopped when no protective garment shielding the cardiac pacemaker is worn.

Furthermore, persons working near radar stations may become ill in most different ways, for example they may suffer liver damage if they do not wear a protective garment shielding the radar radiation. The same will apply to persons working with microwave ovens if these microwave ovens are not shielded in an ideal manner or this shielding is damaged in the course of time.

A material woven, warp-knitted or knitted from the yarn according to this invention may be used for all kinds of garments or articles of clothing protecting against electromagnetic radiations and/or interferences, particularly for protective suits, overalls, two-piece suits, jackets, shirts, sweaters, bonnets or helmets, gloves, shoes or the like for military, industrial, medical and/or personal and private purposes, respectively.

Such protective garments or articles of clothing may be in particular shirts, sweaters, T shirts or other garments for the upper part of the body intended for people having a cardiac pacemaker.

These protective garments may be used within a very wide frequency spectrum and within a very wide range of power density. Particularly, however by no means exclusively, protection is obtained in the HF, UHF, VHF, and microwave frequency ranges.

What is claimed is:

1. A yarn comprising at least one textile thread having a core comprised of a plurality of discrete, non-continuous substantially parallel metallic fibers and a sheath consisting essentially of non-metallic fibers.

2. A yarn as set forth in claim 1 wherein said core consists essentially of metallic fibers with said core and said sheath spun together to form said thread.

3. A yarn as set forth in claim 1 wherein said core is comprised of a plurality of metallic fibers and a plurality of non-metallic fibers blended together with said core and said sheath spun together to form said thread.

4. A yarn as set forth in claim 1 wherein said core is comprised of a plurality of metallic fibers and a plurality of non-metallic fibers which have been blended and spun together to form a twisted core which has been spun with said sheath to form said thread.

5. A yarn as set forth in claim 1 further comprising at least one additional thread consisting essentially of non-metallic fibers.

6. A yarn as set forth in claim 1 wherein said metallic fibers are stainless steel fibers.

7. An electromagnetic shield fabric for use in protective garments, said fabric being comprised of yarns each comprised of at least one textile thread having a core comprised of a plurality of discrete, non-continuous substantially parallel metallic fibers and a sheath consisting essentially of non-metallic fibers.

* * * * *